United States Patent [19]

Yasukawa

[11] Patent Number: 4,838,046

[45] Date of Patent: Jun. 13, 1989

[54] COVER FOR A DAMPENING ROLLER OF AN OFFSET PRESS

[75] Inventor: Akio Yasukawa, Higashiosaka, Japan

[73] Assignee: Katsura Roller Mfg. Co., Ltd., Osaka, Japan

[21] Appl. No.: 904,801

[22] Filed: Sep. 8, 1986

Related U.S. Application Data

[63] Continuation of Ser. No. 694,175, Jan. 23, 1985, abandoned.

[30] Foreign Application Priority Data

Feb. 3, 1984 [JP] Japan ..... 59-19215

[51] Int. Cl.[4] ..... D04B 7/12; D04B 7/16

[52] U.S. Cl. ..... 66/202; 66/194; 101/148

[58] Field of Search ..... 101/148, 348; 29/120, 29/131; 66/194, 195, 196, 197, 190, 202, 170, 198

[56] References Cited

U.S. PATENT DOCUMENTS

| | | | |
|---|---|---|---|
| 2,345,337 | 3/1944 | Gardner | 29/120 |
| 2,775,195 | 12/1956 | Martin | 29/120 X |
| 2,804,762 | 9/1957 | Kameda | 29/120 X |
| 2,958,146 | 11/1960 | Dusen, Jr. et al. | 101/147 |
| 3,067,779 | 12/1962 | Draper, Jr. . | |
| 3,180,115 | 4/1965 | Marshall | 29/120 X |
| 3,242,554 | 3/1966 | Raymond | 29/120 |
| 3,273,224 | 9/1966 | Spicer | 29/120 |
| 3,699,590 | 10/1972 | Weber et al. . | |
| 3,785,178 | 1/1974 | MacHacek et al. | 66/196 |
| 3,926,701 | 12/1975 | Nishiwaki | 101/148 |
| 3,986,530 | 10/1976 | Maekawa . | |
| 4,019,350 | 4/1977 | Schmidt | 66/196 |
| 4,232,082 | 11/1980 | Noritake . | |
| 4,322,232 | 3/1982 | Beane . | |
| 4,400,418 | 8/1983 | Takeda et al. | 29/120 |
| 4,420,529 | 12/1983 | Westhead . | |
| 4,531,386 | 7/1985 | England et al. . | |
| 4,557,968 | 12/1985 | Thornton et al. . | |

FOREIGN PATENT DOCUMENTS

| | | |
|---|---|---|
| 528482 | 10/1940 | United Kingdom . |

*Primary Examiner*—J. Reed Fisher

*Attorney, Agent, or Firm*—Jones, Tullar & Cooper

[57] ABSTRACT

A cover for a damping roller of an offset press is comprising a tubular knitted fabric having two water-shrinkable ground yarns and the hydrophilic pile yarns. The ground yarns are intertwined and respectively form a tubular plain weft-knitted structure in which two ground yarns are alternately knitted so that wales formed by one ground yarn are interposed between two adjacent wales formed by the other ground yarn so that all the wales appear on the face of the fabric. The courses of each plain knitted structure include long sinker loops, the ground yarns being knitted into the respective plain-knitted ground fabric structure to form raised loops. The cover has high shrinking percentages both in radial and axial directions.

1 Claim, 1 Drawing Sheet

COVER FOR A DAMPENING ROLLER OF AN OFFSET PRESS

This is a continuation of co-pending application Ser. No. 694,175 filed on Jan. 23, 1985, now abandoned.

CROSS REFERENCE TO RELATED APPLICATION

This application contains subject matter in common with allowed application, Ser. No. 806,231, now U.S. Pat. No. 4,672,825.

This invention relates to a cover for a dampening roller of an offset press and, more particularly, to a damping cover composed of a tubular knitted fabric and adapted to be fixed onto a dampening roller of an offset press to supply water to a plate cylinder.

In offset printing, it is required to uniformly supply water to a surface of a plate cylinder. To this end, there has been used a dampening arrangement comprising a foam damping roller and a ductor roller. Such dampening rollers are generally provided with a damping layer or cover composed of a water-retaining material such as moleskin, damping paper, woven or knitted fabrics and the like. The most popular damping covers now used are made of a woven or knitted fabric.

U.S. Pat. No. 3,926,701 discloses a damping cover composed of a tubular knitted fabric comprising a water-shrinkable ground yarn composed of multifilament fibers of non-acetalized polyvinyl alcohol, and a hydrophilic pile yarn composed of vegetable or regenerated fibers.

SUMMARY OF THE INVENTION

It is therefore an object of the present invention to provide a cover for a dampening roller of an offset press that can be attached to the roller without a cross-stitching operation.

Another object of the present invention is to provide a cover for a dampening roller of an offset press having high shrinking percentages both in the radial and axial directions.

It has now been found that the shrinking percentage in radial direction can be increased by decreasing the number of needle loops in a course of the knitted fabric, while increasing a length of a sinker loop. Although the decrease in the number of needle loops in the course causes a decrease of a water-retaining property of the knitted fabric, this problem can be solved by a combination of double plain knitting and pile knitting.

According to the present invention there is provided a cover for a damping roller of an offset press, composed of a tubular knitted fabric comprising water-shrinkable ground yarns and hydrophilic pile yarns, the ground yarns respectively forming a tubular plain weft-knitted fabric structure intertwined with each other to form a tubular double plain knitted fabric having piles, wales formed by one ground yarn being interposed between wales formed by the other ground yarn so that all the wales appear on the face of the fabric, courses of each plain knitted structure including long sinker loops.

As the ground yarns, there may be used any of the known water-shrinkable yarns such as, for example, yarns of chemical fibers such as non-acetalized polyvinyl alcohol fibers, or reproduced fibers. However, it is preferred to use yarns having a high shrinking percentage higher than 20%. As the pile yarns, there may be used any of the known hydrophilic yarns such as, for example, yarns composed of viscose rayon fibers, acetate fibers.

The present invention will be further apparent from the following description with reference to the accompanying drawings, which show by way of example only, a preferred embodiment thereof.

DETAILED DESCRIPTION OF THE INVENTION

Figure 2:
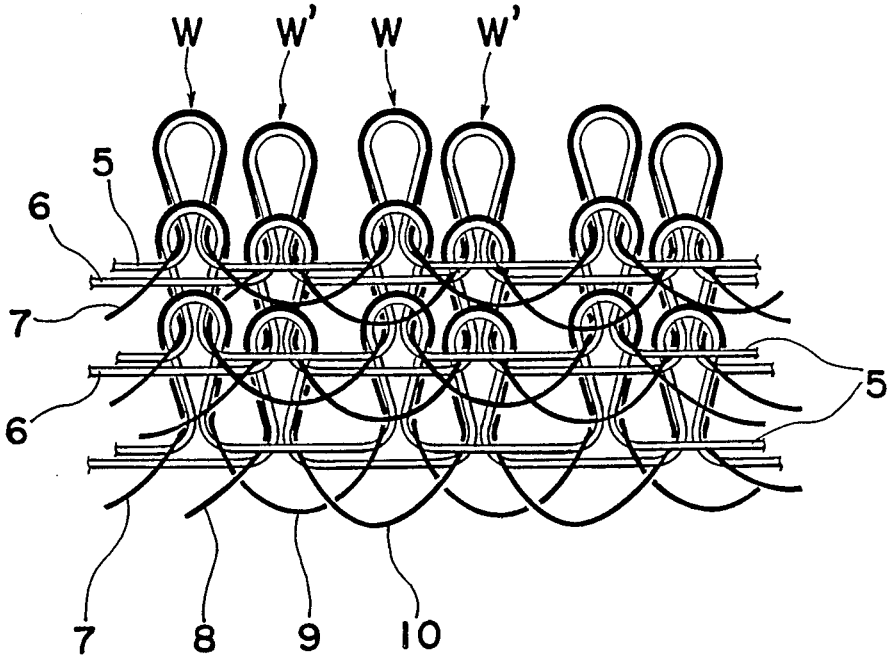
FIG. 2 is an enlarged view showing the back of a double plain knitted fabric structure for use as the cover shown in FIG. 1.

Referring now to the drawings, there is shown a foam damping roller 1 provided with a cover 2 according to the present invention. The cover 2 is composed of a tubular double plain knitted pile fabric comprising two ground yarns 5 and 6, and two pile yarns 7 and 8, as shown in FIG. 2. The tubular double plain knitted fabric consists of a combination of two plain and pile knitted fabric structures having long sinker loops. Wales, W, of one plain knitted structure are formed by the ground yarn 5, while other wales, W', of the other plain knitted structure are formed by the other ground yarn 6 in such a manner that two plain knitted structures are intertwined with each other so that all the wales W and W' appear on the face of the fabric and that the wales W are interposed between the wales W', as shown in FIG. 2. The pile yarns 7 and 8 are knitted into the respective plain knitted structures of the ground yarns 5 and 6 to form raised loops 9, 10 on the back of the fabric. The raised loops 9, 10 may be cut by shearing to form tufts or cut loops. When the tubular double plain knitted fabric is used as a cover for a dampening roller, the fabric is turned inside out to appear as piles on the face of the cover. Accordingly, the back of the fabric becomes the face of the cover.

In FIG. 2, the courses formed by the ground yarn 6 are illustrated as if they were formed in positions slightly shifted downwardly from the courses formed of the ground yarn 5, for the better understanding of the double plain knitted structure. In fact, the courses formed by the ground yarns 5 and 6 are overlapped with each other.

The tubular double plain knitted fabric for the damping cover may be produced by a circular knitting machine comprising a cylinder rotatably mounted on the frame of the machine and a sinker dial provided with sinkers arranged in grooves cut in the dial. The cylinder has two series of latch needles, i.e., a series of high butt needles and a series of low butt needles. These high and low butt needles are respectively arranged in grooves cut in the cylinder wall in every third place. Thus, there are vacant grooves in every third place. The numbers of the high and low butt needles are one-third of the number of the needle grooves cut in the cylinder wall, respectively. The diameter of the cylinder and the numbers of the needles may vary with the size of the cover to be produced.

In another embodiment of the present invention, the high and low butt needles may be arranged side by side. In this case, there is no vacant groove.

In operation, the high and low butt needles are moved up and down by independent cam races acting on the needle butts independently, but all the needles have the same stroke and act in the same direction. The high butt needles in the revolving cylinder ascend in turn to the highest position where the ground yarn 5 and the pile yarn 7 are fed into the needle hook from a yarn feeder, and then descend to the lowest position so that newly formed loop of the yarns is drawn through the previously formed loop forming a part of a tubular plain weft-knitted structure having piles 9. In the same manner, the low butt needles receive the ground yarn 6 and the pile yarn 8 in turn at the highest position from the other yarn feeder and also knit another tubular plain weft-knitted structure having piles 10. These two plain knitted structures are intertwined with each other so that all the wales W and W' appear on the face of the knitted fabric, as shown in FIG. 2. The piles 9 and 10 are formed on the back of the fabric by the sinker plates in the known manner. The fabric thus produced has a tubular double plain knitted structure.

In use, the fabric is turned inside out to prepare a cover having piles on the face of the cover and this cover is fixed on the surface of damping roller by putting the roller in the cover and then immersing the same in water without cross-stitching. The cover shrinks and forms a damping surface of the roller.

When using ground yarns composed of water-shrinkable fibers of non-acetalized polyvinyl acetate (shrinking percentage: 25%) and hydrophilic pile yarns composed of viscose rayon fibers (shrinking percentage: 3%), it is possible to obtain a cover having a radial shrinking percentage of 20 to 25% and an axial shrinking percentage of 25 to 30%.

According to the present invention it is possible to obtain a damping roller cover having a high radial shrinking percentage and a high axial shrinking percentage without a decrease in water-retaining property. The cover according to the present invention may be applied to various damping rollers with a different size in diameter. Since the cover has a high radial shrinking percentage and a high axial shrinking percentage, it ensures that a uniform shrinking force is applied to every part of the damping roller, thus making it possible to prevent the rubber layer of the roller from the compressive strain due to the axial shrinking force of the cover.

EXAMPLE 1

There was prepared a cover composed of a tubular double plain and pile knitted fabric with a 50 mm diameter by knitting two water-shrinkable ground yarns (650 deniel/250 filaments, shrinking percentage: 25%) composed of vinylon fibers (non-acetalized polyvinyl alcohol fiber), and two hydrophilic pile yarns (650 deniel/720 filaments, shrinking percentage: 3%) composed of viscose rayon fiber (VISTRON, trademark) with the aforesaid circular knitting machine comprising a 3 inch cylinder provided with 96 needle grooves, 32 high butt needles and 32 low butt needles, and a sinker dial having 96 sinker plates.

COMPARATIVE EXAMPLE

There was prepared a cover composed of a tubular plain and pile knitted fabric by knitting a ground yarn and a pile yarn with a circular knitting machine comprising a cylinder of 3 inch diameter and 96 needles. The ground yarn and the pile yarn were the same as those used in Example 1.

The thus produced covers were subjected to the measurement of weight and shrinking percentages both in the radial and axial directions when immersed in water. Results are shown in Table 1.

The shrinking percentage was given by the following equation.

$$\text{Shrinking percentage (\%)} = \frac{A - B}{A} \times 100$$

where A is a length or diameter measured before immersing in water and B is a length or diameter measured after immersed in water of 20° C. for 60 minutes.

TABLE 1

| | Cover of Example 1 | | | cover of comparative example | | |
|---|---|---|---|---|---|---|
| | A (mm) | B (mm) | shrinkage (%) | A (mm) | B (mm) | shrinkage (%) |
| radial | 50 | 40 | 20 | 50 | 48 | 4 |
| axial | 100 | 70 | 30 | 100 | 82 | 18 |
| Weight (g/m) | | 84 | | | 164 | |

As can be seen from the results in Table 1, the cover according to the present invention has high shrinking percentages both in the radial and axial directions, as compared with the conventional knitted cover.

EXAMPLE 2

Using the same yarns as those used in example 1, there were prepared covers composed of a tubular double plain knitted fabric with a diameter of 38 mm in the same manner as in example 1. The circular knitting machine used comprises a cylinder of a diameter of $2\frac{1}{2}$ inches provided with 26 high butt needles and 26 low butt needles, and a sinker dial provided with 78 sinker plates. The covers were attached to rubber coated rollers of a 490 mm long and a 50 mm diameter by inserting the roller into the cover and then immersing the same in water to prepare dampening rollers.

COMPARATIVE EXAMPLE 2

There were prepared covers with a diameter of 38 mm in the same manner as in comparative example 1. The circular knitting machine used comprises a cylinder of a diameter of $2\frac{1}{2}$ inches provided with 78 latch needles, and a sinker dial provided with 78 sinker plates. The covers were attached to rubber coated rollers of a 490 mm long and a 50 mm diameter by inserting the roller into the cover, cross-stitching the ends of the cover and then immersing the roller in water to prepare dampening rollers.

The flexibility and contact between the cover and the roller were observed. Results are shown in Table 2.

TABLE 2

| Diameter of roller | cover of example 2 | | | cover of comparative example | | |
|---|---|---|---|---|---|---|
| (mm) | Flex. | Curl | contact | Flex. | Curl | contact |
| 32 | good | avail. | good | good | bad | bad |
| 38 | " | good | " | " | " | " |
| 42 | " | " | " | " | " | " |
| 46 | " | " | " | avail. | bad | bad |
| 50 | " | " | " | " | " | " |

As can be seen from the results in Table 2, the cover of the present invention is adapted for changes in diameter of the damping roller. Thus, the cover of the present invention is superior in flexibility to the comparative example.

Figure 1:
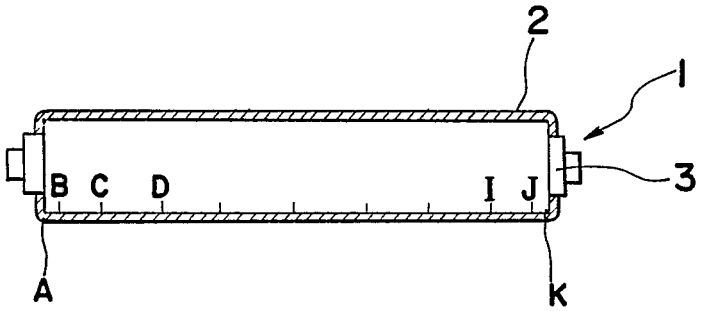
FIG. 1 is a sectional view of a foam damping roller of an offset press provided with a cover of the present invention.

The above damping roller having a 50 mm diameter was subjected to measurement of its outside diameter, $\phi$, at points A, B, . . . , J and K in FIG. 1 to determine compressive strain of the rubber layer of the roller due to shrinking force of the cover. Results are shown in Table 3 together with the distance, d, between the measured point and the end of the roller.

TABLE 3

| | | Example 1 | | Comparative Example | |
|---|---|---|---|---|---|
| Point | d (mm) | $\phi$ (mm) | $\Delta\phi$ (mm) | $\phi$ (mm) | $\Delta\phi$ (mm) |
| A | 10 | 52.80 | +0.55 | 53.65 | +1.40 |
| B | 30 | 52.75 | +0.50 | 52.90 | +0.65 |
| C | 75 | 52.35 | +0.10 | 52.30 | +0.05 |
| D | 125 | 52.30 | +0.05 | 52.35 | +0.10 |
| E | 175 | 52.30 | +0.05 | 52.30 | +0.05 |
| Center F | 225 | 52.25 | 0 | 52.30 | +0.05 |
| G | 175 | 52.30 | +0.05 | 52.30 | +0.05 |
| H | 125 | 52.40 | +0.15 | 52.25 | 0 |
| I | 75 | 52.40 | +0.15 | 52.40 | +0.15 |
| J | 30 | 52.80 | +0.55 | 52.70 | +0.45 |
| K | 10 | 52.70 | +0.45 | 53.35 | +1.10 |

As can be seen from the Table 3, the roller provided with the cover of the present invention shrinks uniformly in the radial direction, thus making it possible to uniformly supply water to a plate cylinder.

What I claim is:

1. A cover for a dampening roller of an offset press, comprising a tubular knitted fabric having two water-shrinkable ground yarns and two hydrophilic pile yarns, said ground yarns being the one selected from the group consisting of yarns of chemical fibers having a shrinkage percentage higher than 20%, said pile yarns being the one selected from the group consisting of yarns of viscose rayon fibers and acetate fibers, said ground yarns being intertwined and respectively forming a tubular double plain weft-knitted fabric structure in which two ground yarns are alternatively knitted so that wales formed by one ground yarn are interposed between two adjacent wales formed by the other ground yarn so that all the wales appear on the face of the fabric, the course of each plain knitted structure including long sinker loops, and said pile yarns being knitted into the respective plain-knitted ground fabric structure to form raised loops, said tubular knitted fabric having a radial shrinkage percentage of 20 to 25% and an axial shrinkage percentage of 25 to 30%.

* * * * *